United States Patent [19]

Watanabe et al.

[11] 4,411,231

[45] Oct. 25, 1983

[54] CARBURETOR THROTTLE VALVE ACTUATOR

[75] Inventors: Shunso F. Watanabe, Livonia; Theodore W. Daykin, Dearborn; Elmer T. Heiney, III, Huntington Woods, all of Mich.

[73] Assignee: Ford Motor Company, Dearborn, Mich.

[21] Appl. No.: 369,326

[22] Filed: Apr. 16, 1982

[51] Int. Cl.[3] ..... F02M 3/00; F02D 31/00

[52] U.S. Cl. ..... 123/339; 123/350

[58] Field of Search ..... 123/339, 350, 361, 376, 123/377; 180/178, 179

[56] References Cited

U.S. PATENT DOCUMENTS

| | | | |
|---|---|---|---|
| 2,929,369 | 3/1960 | Staege | 123/339 |
| 2,973,051 | 2/1961 | Teetor | 180/178 |
| 3,270,728 | 9/1966 | Mizuno | 123/337 |
| 3,392,799 | 7/1968 | Ishikawa | 180/178 |
| 3,476,204 | 11/1969 | Westby et al. | 180/178 |
| 3,476,205 | 11/1969 | Kato | 180/178 |
| 3,547,216 | 12/1970 | Marie | 180/178 |
| 4,112,885 | 9/1978 | Iwata et al. | 123/361 |
| 4,187,734 | 2/1980 | Mann | 180/178 |
| 4,192,398 | 3/1980 | Hunt | 180/178 |
| 4,212,272 | 7/1980 | Hawk | 123/339 |
| 4,237,742 | 12/1980 | Barthruff | 180/178 |
| 4,319,658 | 3/1982 | Collonia et al. | 123/350 |
| 4,367,708 | 1/1983 | Nakamura et al. | 123/339 |

*Primary Examiner*—William A. Cuchlinski, Jr.
*Attorney, Agent, or Firm*—Robert E. McCollum; Clifford L. Sadler

[57] ABSTRACT

A motor vehicle throttle valve positioner consisting of an elongated screw means moving the throttle valve and providing two ranges of movement, one being an engine idle speed mode of operation to maintain the engine at the correct idling speed level as determined by a microprocessor or similar electronic control, the other being a speed control mode of operation wherein a chosen engine off-idle speed level is maintained, and a failsafe operation returning the throttle valve to the idle speed range in the event of electrical failure or termination of the speed control mode of operation.

9 Claims, 2 Drawing Figures

CARBURETOR THROTTLE VALVE ACTUATOR

Figure 1:
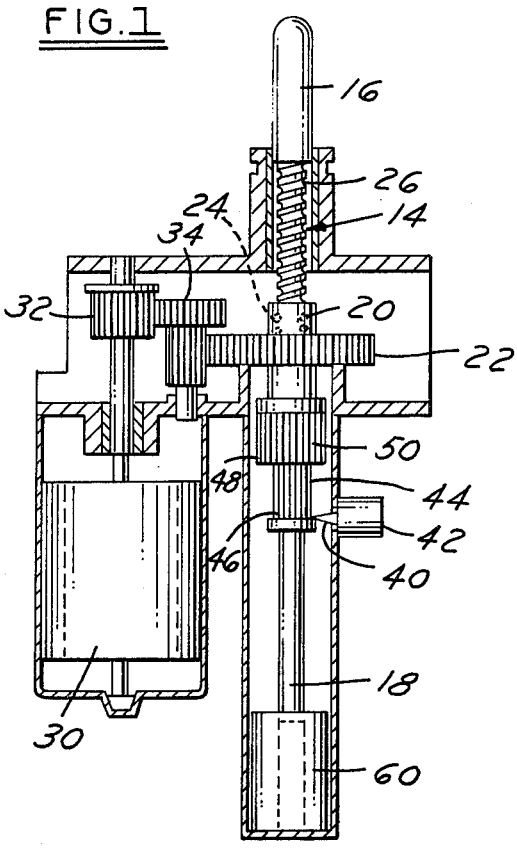

This invention relates in general to a motor vehicle carburetor. More particularly, it relates to a dual mode carburetor throttle valve actuator for regulating the idling speed of the engine during one mode of operation, and the engine off idle speed during a second mode.

Devices are known in the prior art for automatically regulating the idle speed of an automotive type engine to maintain it at a set level regardless of the cut in or out of accessories, such as, for example, air conditioning units. Devices are also known for regulating the speed of the vehicle during engine off idle operating conditions to maintain a chosen speed level. For example, U.S. Pat. No. 4,212,272, Hawk, shows and describes gearing connected to a motor vehicle throttle valve and intermittently driven by a motor energized in response to sensors to maintain a predetermined engine idle speed.

U.S. Pat. No. 2,929,369, Staege, shows a mechanical regulation of a fuel pump to maintain a predetermined idling operation.

U.S. Pat. No. 4,192,398, Hunt, shows a screw and nut combination controlled by an intermittently operated motor to position the engine throttle, or the rack of a fuel injection pump, to provide a speed control type of operation.

U.S. Pat. No. 3,270,728, Mizuno, shows an electrically driven gearing connected to a carburetor throttle valve to control the position of the same to maintain the vehicle at a set speed.

U.S. Pat. No. 3,392,799, Ishikawa, shows gearing driven by a motor electrically controlled to provide a desired constant speed level.

U.S. Pat. No. 2,973,051, Teetor, illustrates the use of a screw and nut combination to effect the angular movement a member to maintain the speed of a motor vehicle at a desired level.

U.S. Pat. No. 4,187,734, Mann, also shows motor driven gearing to provide a speed control function for a motor vehicle.

U.S. Pat. No. 4,237,742, Barthruff, U.S. Pat. No. 4,112,885, Iwata et al., U.S. Pat. No. 3,547,216, Marie, U.S. Pat. No. 3,476,205, Kato, and U.S. Pat. No. 3,476,204, Westby et al., are further illustrations of electrical controlled positioners for the throttle valve of a motor vehicle to maintain a constant speed level.

While the above known devices provide constructions that will control the idle speed of a motor vehicle as well as off idle speed levels of the vehicle, none show a construction providing both controls in one construction. This invention relates to a throttle valve actuator that provides a dual mode of operation; i.e., two ranges of movement, one controlling the position of the engine throttle valve during an engine idle speed range of movement, and the second controlling the throttle valve between engine off idle and fully wide open positions.

More particularly, this invention relates to an elongated screw means that is adapted to be held against rotation but is movable longitudinally by electrically driven means sensitive to the conditions of operation of the engine, either to provide a varying idle speed range of operation or a constant speed range of operation in the engine off idle operating conditions, the screw means operatively engaging the throttle valve of the carburetor/vehicle accelerator pedal in a manner to provide the speed level desired.

This invention is further defined by a longitudinally movable screw means to which is attached a pair of splined portions of differing diameters cooperating with a selectively operable holding means to prevent rotation of the screw means while permitting a longitudinal transitory movement to position the throttle lever or valve in the desired position to attain the engine or vehicle speed called for; the holding means being alternately engageable with the different diameter splined portions, each of which define, by the longitudinal extent of its splines, a different range of travel of the throttle valve.

It is a still further feature of the invention to provide a throttle valve actuator of the type described having a fail-safe movement upon discontinuance of the speed control mode of operation, consisting of means to automatically return the actuator to the idle speed mode of operation.

Figure 2:
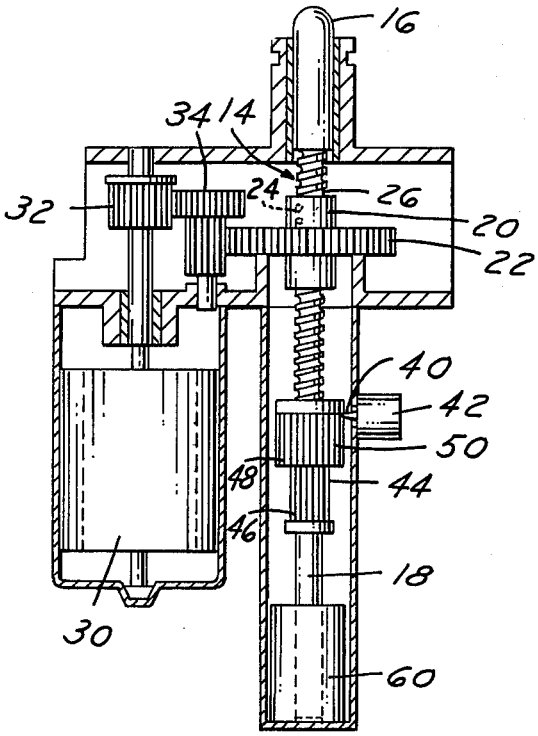

Other objects, features and advantages of the invention will become more apparent upon reference to the succeeding detailed description thereof, and to the drawings illustrating the preferred embodiment thereof; wherein, FIG. 1 schematically illustrates a plan view, with parts broken away and in section, of a motor vehicle throttle actuator embodying the invention; and, FIG. 2 is a view similar to FIG. 1 illustrating the parts in different operative positions.

FIG. 1 illustrates an assembly 10 for controlling the speed of a motor vehicle, not shown. The vehicle would have the usual accelerator pedal operatively connected by linkage (not shown) to a throttle valve controlling flow of air and fuel through the conventional carburetor induction passage in a known manner. Depression of the pedal normally provides the sole control for opening and closing the throttle valve to change the speed of the engine. This invention relates to an additional means to control the speed of the engine in two ranges of operation by positioning the throttle valve.

More particularly, the device of FIG. 1 includes an enlongated ball screw 14 having an output shaft 16 at one end and a position indicator 18 at the opposite end. The ball screw is adapted to cooperate in a known manner with a sleeve-type nut 20 keyed on its outer diameter to a drive gear 22. The nut 20 would have suitable straight internal races or tracks that receive a plurality of balls 24 that also are received in the external helical formed races or tracks 26 of the ball screw 14. Holding the ball screw against rotation while permitting its longitudinal movement, and rotating nut 20 while holding it against axial movement, will cause an axial or longitudinal movement of ball screw 14 in one or the other directions as determined by the direction of rotation of gear 22, the balls 24 exerting an axial force on the ball screw races as the balls travel in a circular manner around with nut 20.

The gear 22 in this case is driven by a reversible motor 30 connected to gear 22 by a pinion gear 32 and an intermediate gear 34. As will be explained more fully later, the motor is adapted to be connected to a microprocessor or similar electronic control unit for the engine. Inputs to the unit would sense the various operating conditions of the engine and provide an output to motor 30 to drive the same in either a forward or reverse direction as is required.

The ball screw 14 in this case is held against rotation by a spring retracted armature 40 of an electrically controlled solenoid represented schematically at 42. The armature engages alternately the splines 44 of a small diameter sleeve 46 fixed to shaft 14, or the splines 48 of a second larger diameter sleeve portion 50 also secured to ball screw 14, depending upon the energization or deenergization of solenoid 42. The two splined portions actually constitute a stepped diameter sleeve splined along its entire length, with the splines of both portions extending inwardly to the same depth, the splines of the larger diameter portion, however, projecting radially outwardly farther than the splines 44. This will permit a downward (as seen in FIG. 1) longitudinal movement of ball screw 14 with armature 40 engaged in the splines 44 of sleeve 46 as seen in FIG. 1, and subsequent automatic engagement with splines 48 upon continued downward movement of the ball screw.

On the other hand, disengagement of armature 40 from the FIG. 1 position, by retracting it to a position out of engagement with the splines 44, will axially align the armature end with the outer portions of splines 48 ready to engage the same when the screw 14 moves to the FIG. 2 position.

The axial extent or width of splines 48 in this case determine the minimum and maximum limits of the engine idle speed mode of operation or range of movement. The axial width of splines 44 similarly define the maximum and minimum throttle valve opening positions for a speed control mode of operation or range of movement.

The lower end of ball screw shaft 18 is slideably engageable with, in this case, a six position encoder or position indicator identified at 60. It is operatively connected to a microprocessor or similar electronic control (not shown) responsive to engine operating conditions for providing input signals to motor 30 to move it in a forward or reverse direction. Assume that the engine is in the off condition (FIG. 2). Upon shutoff of the electrical system, motor 30 is off, solenoid 42 wil be deenergized, and armature 40 withdrawn to a position not capable of engagement with splines 44 but in engagement with the outer portions of splines 48. The carburetor throttle valve return spring, not shown, which usually has a three to six pound force, will have pushed the ball screw 14 in a downward direction as seen in the figures.

The details of construction and assembly of the carburetor throttle valve return spring are not shown since they are well known and, therefore, believed to be unnecessary for an understanding of the invention. Suffice it to say that it would be similar in operating principle to those springs shown at 24 in Hawk, previously referred to, or at 9 in Mizuno, or 28 in Teetor, also previously referred to above.

The throttle lever, therefore, is now in its essentially closed position, which is indicated to encoder 60 by the position of the lower end 18 of screw 14. When it is desired to start the engine, turning of the ignition key will energize the electrical system and send a signal from the encoder to the microprocessor identifying the position of the throttle lever. If the engine is cold, the microprocessor senses that the throttle valve should be open wider (for greater air/fuel flow) than during normal operating temperature conditions, to overcome the increased friction, etc., at this temperature level. Therefore, motor 30 will be energized to rotate drive gear 22 to cause ball screw 14 to move upwardly by an amount sufficient to place the throttle lever in the open or hot idle speed position. This, of course, will be effected by holding of screw 14 against rotation but sliding of splines 48 longitudinally relative to the stationary armature 40. The actual location of the throttle lever will, of course, be determined by the degree of coldness of the engine. The maximum idle speed throttle valve opening will occur when the lower edge portion of splines 48 engage armature 40. Once the engine is started, then the microprocessor will adjust the position of screw 14 in response to signals indicating the difference in the speed of the engine from the design level called for.

In the idle speed range of operation, therefore, whenever the actual speed of the vehicle during this mode of operation varies from the desired one as set by the microprocessor, the motor 30 will be energized to drive the screw gear 22 to longitudinally move the ball screw 14 to change the idle speed to the correct level.

It will be clear, of course, that the throttle lever can be moved by the vehicle operator to override the control of the ball screw to open the carburetor throttle valve to any desired level to manually increase the vehicle speed beyond the set level called for.

Turning now to the speed control mode of operation shown in FIG. 1, the known speed control systems generally do not operate below a motor vehicle speed of, say, 30 miles per hour or above a higher speed level of 80 miles per hour, for example. Assume that the vehicle has been accelerated to a speed of, say, 50 miles per hour, and the speed control system activated, a signal now is sent to the electronic unit indicating the 50 mile per hour speed level to be maintained. Motor 30 will be energized to drive screw gear 22 to move ball screw 14 longitudinally upwardly from the position shown in FIG. 2. Solenoid 42 is energized to project the armature 40 radially outwardly into engagement with the lower or inner portions of spline 48. Therefore, the ball screw 14 will be held against rotation and moved longitudinally upwardly as armature 40 moves from splines 48 to splines 44. The longitudinal extent of the splines 44 determine the maximum and minimum throttle valve openings for the speed control mode of operation. When the screw reaches the position opening the throttle valve enough to establish the speed called for, then motor 30 will be deenergized, but not solenoid 42. Screw 14 will stop with armature 40 at some intermediate point on the width of splines 44 indicating the speed level called for. Any deviations of the actual vehicle speed from the set or desired speed will again cause energization of motor 30 to relocate the ball screw 14 in the desired position that will accomplish the speedup or reduction of speed of the motor vehicle. Armature 40 will be engaged with the lower end or edge of splines 44 when the motor vehicle is conditioned for its maximum constant speed setting in the speed control mode.

A feature of this construction is the fail-safe nature of the device. If for any reason an electrical failure should occur, solenoid 42 and motor 30 would be deenergized. Armature 40 then would be withdrawn from the splines 44 under the action of its spring, not shown, and the ball screw would be free to freewheel or rotate, if the screw 14 is in the FIG. 1 position. Accordingly, upon release of the vehicle accelerator pedal, the three to six pound force of the carburetor throttle valve return spring would push the ball screw 14 downwardly. The efficiency of the ball screw is such that the spline will freewheel at only approximately a one-half pound force. The motor 30 will not backdrive below a force of about one to one and one-half pounds, for example. Therefore, the screw will rotate in gear 22. The splined sleeves 46 and 50, therefore, are pushed downwardly while freewheeling until the armature 40 engages the outer portions of splines 48, at which point the ball screw will stop rotating. However, since the carburetor return spring force of three to six pounds is greater than the one and one-half pound force required to backdrive motor 30, gear 22 now will rotate and permit a further axial or longitudinal movement of ball screw 14 until splines 48 locate the armature at the lower end of the idle speed control range, as indicated in FIG. 2.

From the foregoing, it will be seen that the invention provides a throttle valve actuator having a two-step function; one to control operation in an idle speed range of movements, and a second to control operation in a speed control range of movements, both by the use of a single ball screw means, and including a fail-safe operation of the device by return to the idle speed range of movements in the event of electrical failure or discontinuance of operation of the speed control mode.

While the invention has been shown and described in its preferred embodiment, it will be clear to those skilled in the arts to which it pertains that many changes and modifications may be made thereto without departing from the scope of the invention. For example, it will be clear that devices operated by vacuum, hydraulically, or pneumatically could be substituted for the solenoid 42 and armature 40, all within the scope of the invention.

We claim:

1. A motor vehicle throttle valve actuator comprising a longitudinally movable actuator having a first range of movement for actuating a vehicle throttle valve in a speed control mode and having a second range of movement for actuating the vehicle throttle valve in an engine idle speed control mode;

a drive means coupled to said actuator for effecting the longitudinal movement of said actuator in said ranges;

clutching means engageable with said actuator for rendering the actuator operable in said ranges;

the actuator comprising an elongated screw means coupled to the drive means;

the clutching means being engageable with said screw means to hold the screw means against rotation while permitting a transitory longitudinal movement of the screw means between minimum and maximum throttle valve opening positions in response to drive thereof by the drive means, and spring means biasing the screw means in a throttle valve closing direction toward the second range of movement;

the said clutching means including a stepped diameter splined means having first and second portions of differing diameters fixed to the screw means engagable alternately by the holding means to define the ranges of movements of the screw means;

the longitudinal extent of the smaller diameter first portion of the splined means defining lower and upper limits of the speed control range of movement of the screw means and throttle valve, the longitudinal extent of the larger diameter portion of the splined means defining the upper and lower limits of the idle speed control range of movement of the screw means and throttle valve, the displacement of the holding means from the first portion spline permitting a free wheeling longitudinal movement in an axial throttle valve closing return movement of the screw means under the bias of the spring means until the holding means engages the splines of the second portion to again hold the screw means against rotation in the idle speed control range.

2. A motor vehicle throttle valve actuator comprising a longitudinally movable actuator having a first range of movement for actuating a vehicle throttle valve in a speed control mode and having a second range of movement for actuating the vehicle throttle valve in an engine idle speed control mode;

a drive means coupled to said actuator for effecting the longitudinal movement of said actuator in said ranges; and clutching means engagable with said actuator for rendering the actuator operable in said ranges;

the actuator comprising an elongated screw means coupled to the drive means;

the first range of movement being defined by the movement of the throttle valve between an off idle speed lower limit position and a fully open throttle valve upper limit position;

the second range of movement being defined by the movement of the throttle valve between an essentially closed lower limit position and an open engine idle speed throttle valve upper limit position;

the first and second ranges of movement also being defined respectively by the longitudinal extents of first and second splined portions of differing diameters of a stepped diameter sleeve secured to the screw means, the clutching means including a holding means alternately engagable with and slidable relative to the splines of the first and second portions to prevent rotation of the screw means while permitting longitudinal movement of the portions and screw means in the first and second ranges of movement.

3. An actuator as in claim 2 including spring means biasing the screw means.

4. An actuator as in claim 3, the splined portions being axially aligned with the splines of one being axially contiguous to the splines of the other.

5. An actuator as in claim 3, disengagement of the holding means from the first splined member permitting freewheeling rotation of the screw means relative to the drive means under the bias of the spring means to return the screw means in a throttle valve closing direction to the lower limit of the first speed control range of movement and engagement of the holding means with the second member.

6. An actuator as in claim 3, the drive means being selectively operable.

7. An actuator as in claim 2, the holding means comprising a solenoid having an armature engagable with the splines of the members, spring means biasing the armature to a first withdrawn position disengaged from the first splined portion and engaged with the second portion, the solenoid when energized being extended to a second position to engage the splines of the first portion.

8. An actuator as in claim 6, inoperability of the drive means permitting a throttle valve closing return movement of the screw means under the bias of the spring means to the idle speed second range of operation by a backdrive of the drive means by the screw means.

9. An actuator as in claim 7, the radial outward projection of the splines of the second idle speed portion being greater than that of the first splined portion, the inner diameters of the splines of both portions extending to the same depth.

* * * * *